US007913332B1

(12) United States Patent
Barnhart

(10) Patent No.: US 7,913,332 B1
(45) Date of Patent: Mar. 29, 2011

(54) DRAWN AIR BED VENTILATOR

(76) Inventor: James Louis Barnhart, Sunnyvale, CA (US)

( * ) Notice: Subject to any disclaimer, the term of this patent is extended or adjusted under 35 U.S.C. 154(b) by 729 days.

(21) Appl. No.: 11/799,398

(22) Filed: Apr. 30, 2007

(51) Int. Cl.
*A47C 21/04* (2006.01)

(52) U.S. Cl. ..... 5/423; 5/421; 5/724; 5/910

(58) Field of Classification Search ..... 5/423, 421, 5/658–659, 910
See application file for complete search history.

(56) References Cited

U.S. PATENT DOCUMENTS

| | | | | |
|---|---|---|---|---|
| 2,695,413 | A | 11/1954 | Ter Maat | |
| 3,230,556 | A * | 1/1966 | Shippee | 5/423 |
| 3,444,922 | A | 5/1969 | Dingman | |
| 5,730,120 | A | 3/1998 | Yonkers, Jr. | |
| 6,370,718 | B1 | 4/2002 | Schmid | |
| 6,425,527 | B1 * | 7/2002 | Smole | 236/49.3 |
| 6,508,850 | B1 | 1/2003 | Kotliar | |
| 6,546,576 | B1 | 4/2003 | Lin | |
| 6,859,962 | B2 | 3/2005 | Diak/Ghanem | |
| 6,934,985 | B2 | 8/2005 | Sanders | |
| 7,036,575 | B1 | 5/2006 | Rodney et al. | |
| 7,107,638 | B2 | 9/2006 | Wilson | |
| 2003/0019044 | A1 * | 1/2003 | Larsson et al. | 5/724 |
| 2006/0008918 | A1 * | 1/2006 | Probert et al. | 436/106 |
| 2006/0101577 | A1 | 5/2006 | Lussier | |

* cited by examiner

*Primary Examiner* — Fredrick Conley

(57) ABSTRACT

A ventilator system for a bed that withdraws air from under the bedding covers to provide fresh airflow along a sleeper's body is disclosed. The bed ventilator system includes an air removal extraction device at one end of a single bed, or along the lower-half sides of a shared bed, between the bottom sheet and the bed covers at the mattress top surface. A conduit directs withdrawn air from the extraction device to a vacuum generating system that provides negative air pressure as a motive force to withdraw air. The system provides air flow in the natural hair follicle direction, relieving bed occupants from both temperature and bodily odor distractions.

3 Claims, 4 Drawing Sheets

DRAWN AIR BED VENTILATOR

CROSS-REFERENCE TO RELATED APPLICATIONS

Not Applicable

BACKGROUND OF THE INVENTION

1. Field of Invention

This invention generally relates to bed ventilators, specifically to bed ventilators that move fresh air under bedding covers along the bodies of persons resting therein.

2. Prior Art

Stagnant air trapped about sleepers' resting bodies inhibits restful slumber. This stagnant air is shared between bedmates, raising the temperature under the bed covers, and trapping foot, underarm, flatus, or other bodily odors. Any attempt to freshen the entrapped air by raising and lowering the bed covers in a bellows flapping fashion causes the stagnant air to circulate from the tucked foot end and out through the untucked head end. While such air refreshing may temporarily modify the undercover air temperature, any malodorous air exits past the sleeper's face and nose. This situation is especially disruptive to restful sleep when one bedmate is stricken with flatulence that is only able to exit about the bed occupants' faces and noses. The mere act of a sleeper changing position or rolling over beneath bed covers may produce a sufficient bedcovers bellows effect to give the resting persons a faceful of malodorous flatus.

Prior attempts to address the bed ventilation problem can be broadly grouped into four categories: a tent system, a specialized mattress system, a forced air system, or a specialized bed sheet covers system. Each of these systems inadequately addresses the twin temperature and malodorous air problems. The tent system as typified by U.S. Pat. No. 2,695,413 to Maat requires a frame infrastructure, and a powerful pump to force air through a HEPA filter. A high volume pump is required to change over the tented air volume in the case of Kotliar in U.S. Pat. No. 6,508,850. The Maat tent recirculates malodorous air and flatus about the occupant in an undesirable manner. The Kotliar tent forces the malodorous air and flatus past the face and nose of the sleeper in a most offensive flow pattern.

The specialized mattress system as represented by U.S. Pat. No. 6,370,718 to Schmid and U.S. Pat. No. 6,546,576 to Lin require extensive specialized support construction. A powerful high volume fan percolates air through the mattress interior and out through the top cover. An impermeable, nonporous sidewall foundation contains air pressure; multiple apertures percolate the forced air out the mattress top cover. This non-breathable mattress material exacerbates sleeper discomfort by amplifying perspiration from bodily contact with the mattress surface between air apertures. Special bedding with elasticized straps along the periphery is also required to maintain taut contact with the mattress top as needed to effect airflow. Even with the special sheets, bedding, and cover materials, all malodorous air and flatus are undesirably circulated past the face and nose of the sleeper because the only opening for system exhaust is about the head and shoulders of a covered body in bed.

The forced air system as characterized by U.S. Pat. No. 5,730,120 to Yonkers, Jr. requires a wide fan and conduit configuration that produces an aesthetically displeasing appearance when attached to a bed. It also necessitates the top bed sheet to be left untucked for air inlet, increasing the likelihood of airflow disruption when the loose bedding blocks the inlet. Forced air devices may also place electrical wires proximate to a bed occupant, increasing the risk of electrical fire or possible electrocution. Many forced air systems operate continuously during the sleep cycle creating disruptful noise and consuming excessive amounts of electrical energy. Prior art forced air systems push air from beneath the bed covers that escapes at the untucked head of the bed. This airflow from toe to head is the reverse of the natural hair growth direction and is less pleasing than the natural head to toe flow. The design of U.S. Pat. No. 7,036,575 to Rodney et al relies upon residual thermal effect to reduce energy consumption by requiring direct bodily contact with the device in bed. Such foreign object contact in bed generally causes discomfort and disrupts restful sleep. The forced air systems do nothing to alleviate malodorous air and flatus. Depending upon the configuration, they may actually exacerbate the problem by forcing noxious odors past the face and nose of the tucked in sleeper. That is, forced air ultimately channels along the sleeper's body to exist from under the bed covers at the sleeper's shoulders and head.

The specialized ventilated covers typified by U.S. Pat. No. 7,107,638 to Wilson and U.S. Pat. No. 6,934,985 to Sanders require vent cutouts in the bed covers themselves to allow increased airflow during slumber. Such cutouts in covers can only be had by purchase of specialized bedding or by mutilation of otherwise functional bedding materials. There is no certainty that the special vent cutouts will be placed over body parts that most need thermal relief, nor can it be certain that full flatus or other bodily odor will exit from under the covers and away from a sleeper's face. Undesirable odors may still pass the face and nose of sleepers from under the ventilated covers. Even if released via intended cutouts, the malodorous air will hang about the bed area to the dismay of those trying to sleep.

What is needed is a bed ventilation system that removes air from under the bed covers by drawing air from head to toe along a body at rest. Instead of the positive air pressure systems prevalent in the prior art, the air motive force should employ negative air pressure. The air motive force should be located away from the sleeper's head and preferably under the bed to help muffle operational noise. The bed covers themselves form air travel conduits with the sleeper's bodily contours forming the flow channel infrastructure. The ideal bed ventilation system avoids inadvertent bodily contact by a sleeper in bed with ventilation system components. This assures maximum relief from all air moved as well as minimizing the volume of air needing to be moved in order to effect sleeper relief.

The ideal bed ventilation system should integrate with standard mattress and bedding materials to minimize the investment needed on the part of the consumer. This improved bed ventilation system optionally can detect the presence of flatus and activate automatically as necessary to discreetly remove malodorous content. Optionally the system can employ a remote control accessible on a nightstand to provide thermal or odor relief as desired. For shared bed arrangements the partners should be able to control air flow on their respective side of the bed to minimize disturbance to the other partner. The ideal bed ventilation system should also filter malodorous content from evacuated air before release into the sleeping chamber. By sensing undercover temperature the bed ventilation system automatically operates to provide cooling airflow when temperatures exceed a set point determined by the individual sleepers. A novel bed sheet tensioning mechanism ensures no blockage of an air extraction device while simultaneously enhancing sleeper comfort by removing uncomfortable wrinkles from the bed covering.

OBJECTS AND ADVANTAGES

Accordingly, several objects and advantages of the invention are:

1. to provide a bed ventilation system that draws soothing air from head to toe along the body of a bed occupant at rest, rather than pushing air from toe to head which is unsettling due to air flowing against the natural body hair follicle growth direction;
2. to provide a negative air pressure (as opposed to positive air pressure from toe to head prevalent the prior art) bed ventilator system that removes malodorous air and flatus from under bedding covers;
3. to provide a bed ventilation system that reduces noise to enable better restful sleep;
4. to provide a bed ventilation system that conserves electric power relative to existing bed ventilator solutions by using drawn air negative pressure from a low volume space;
5. to provide a bed ventilation system that couples with a standard mattress, thereby saving cost, adding convenience, and improving comfort relative to specialized ventilation mattress systems;
6. to provide a bed ventilation system that uses standard sheet and bedding cover sets;
7. to provide a bed ventilation system that integrates with a standard bed with a mattress configuration that obviates the frame rails infrastructure of existing tent ventilation systems;
8. to provide a bed ventilation system that senses the presence of hydrogen sulfide (H2S), mercaptan, or methane malodorous flatus content and automatically draws air to remove flatus from under bedding covers without disturbing the bed's occupants;
9. to provide a bed ventilation system that incorporates a discretionary remote control capability to draw comforting air or to remove flatus as desired;
10. to provide a bed ventilation system that draws soothing air along a body at rest and that removes malodorous air and flatus from under bedding covers for single or double bed occupant sleeping arrangements, and providing each bed occupant an independent air flow control for the occupant's respective side of the bed;
11. to provide a bed ventilation system that removes malodorous content from withdrawn air and prevents said malodorous content from discharge into the bedroom;
12. to provide a bed ventilation system with which a bed occupant need not make contact while in bed;
13. to provide a bed ventilation system that senses temperature under bed covers and automatically withdraws air to cool bed occupants when warmer than optimal, and ceases air withdrawal to allow bed occupants to warm when cooler than optimal;
14. to provide a convenient bed sheet tensioning method that is suitable for use both with the present bed ventilation system and absent the bed ventilation system to present a comfortable, wrinkle-free, aesthetically-pleasing bed.

Further objects and advantages will become apparent from a consideration of the ensuing description and drawings.

SUMMARY

In accordance with the invention, a new and improved ventilator system for a bed that withdraws air from under the bedding covers to provide fresh air flow along a sleeper's body from head to toe is disclosed. Optionally, air may flow along other directions along the sleeper's body. The bed ventilator system includes an air extraction device, such as an intake nozzle, perforated pipe, or equivalent, that fits across the foot of a single bed or along the lower half sides of a shared bed between the bottom sheet and the bed covers. Twin supports having thin flat feet designed to be slid between a mattress and a supporting bed structure attach to and hold in place the extraction device at the mattress top surface. A conduit directs withdrawn air from the extraction device to a vacuum generating system, such as an electric pump, that provides negative air pressure as a motive force to withdraw air. The vacuum generating system is preferably located underneath the bed or at the foot of a non-raised bed support structure.

Sheet tensioning may be accomplished by providing retracting bands that pull toward the bed centerline parallel to the twin support flat feet between the mattress and box spring support. Flat clips on the free ends of the retracting bands attach to the edge of the top sheet to provide slight tension to the top sheet in the tucked direction over the air extraction device along the sides and beneath the feet of the twin supports. Sheet tensioning ensures no bedding blockage of the extraction airflow, enhances sleeper comfort by removing uncomfortable wrinkles, and provides an aesthetically pleasing made-bed appearance.

DRAWINGS\FIGURES

REFERENCE NUMERALS IN DRAWINGS

10 Drawn Air Bed Ventilator
12*a* Extraction Device
12*b* Extraction Device
14*a* Extraction Support
14*b* Extraction Support
16 Conduit
18 Vacuum generating system
20 Top Sheet Bed Cover
22 Pillow
24 Headboard
26 Footboard
28 Mattress
30 Mattress Support
32 Temperature Sensor
34 Flatus Sensor
36 Exhaust Filter Deodorizer
38 Remote Control
40 Bed Occupant
42 Diverter Valve
44 Anchor Strap
46 Anchor Point

48*a* Sheet Clip
48*b* Sheet Clip
48*c* Sheet Clip
48*d* Sheet Clip
50*a* Tensile Band
50*b* Tensile Band
52*a* Anchor Bracket
52*b* Anchor Bracket
52*c* Anchor Bracket
52*d* Anchor Bracket

DESCRIPTION

Figure 1:
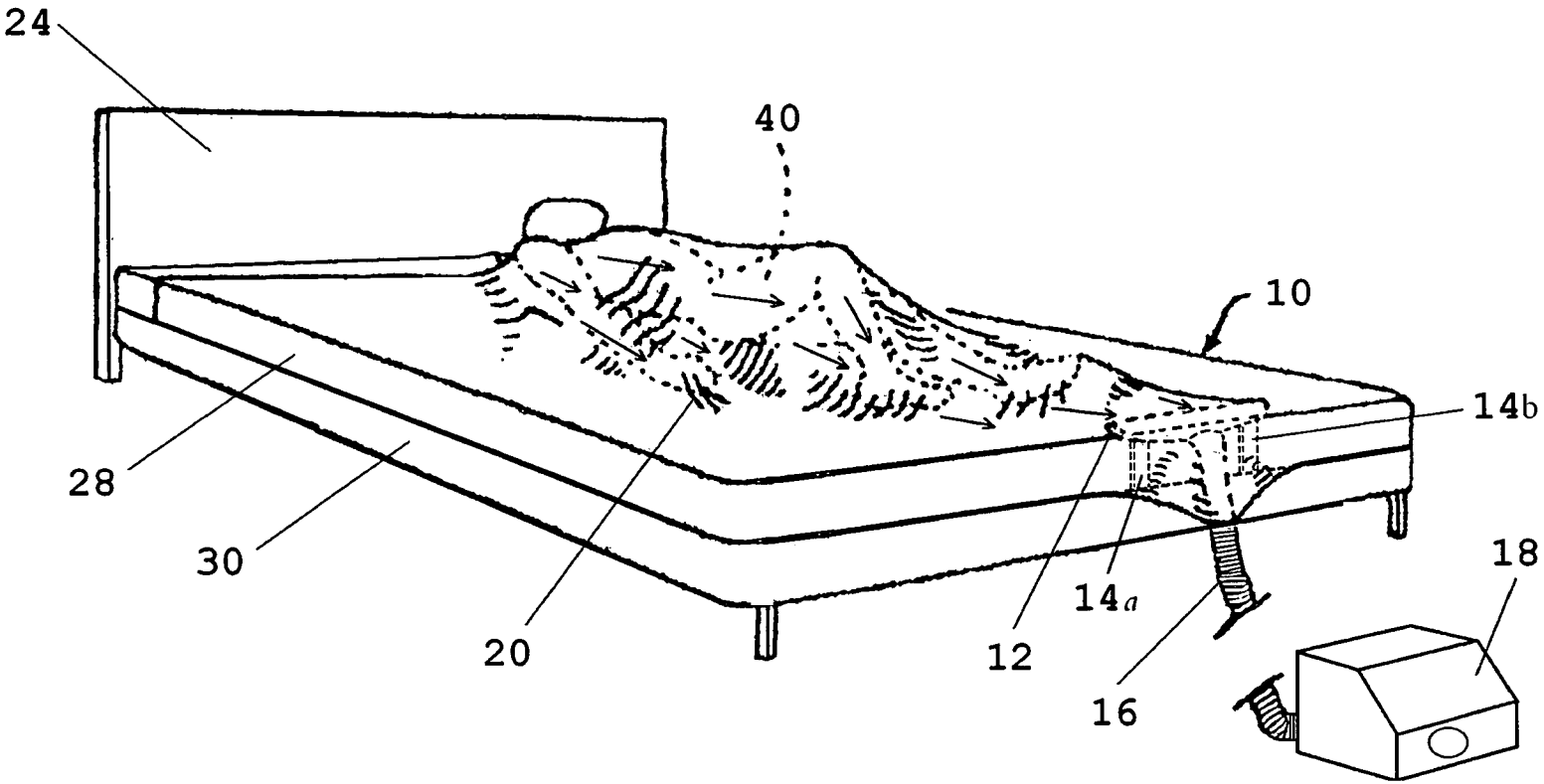
FIG. 1 is a perspective view of the bed ventilation system in combination with a bed and bed occupant illustrating the movement of the air about the body of the bed occupant.
Figure 2:
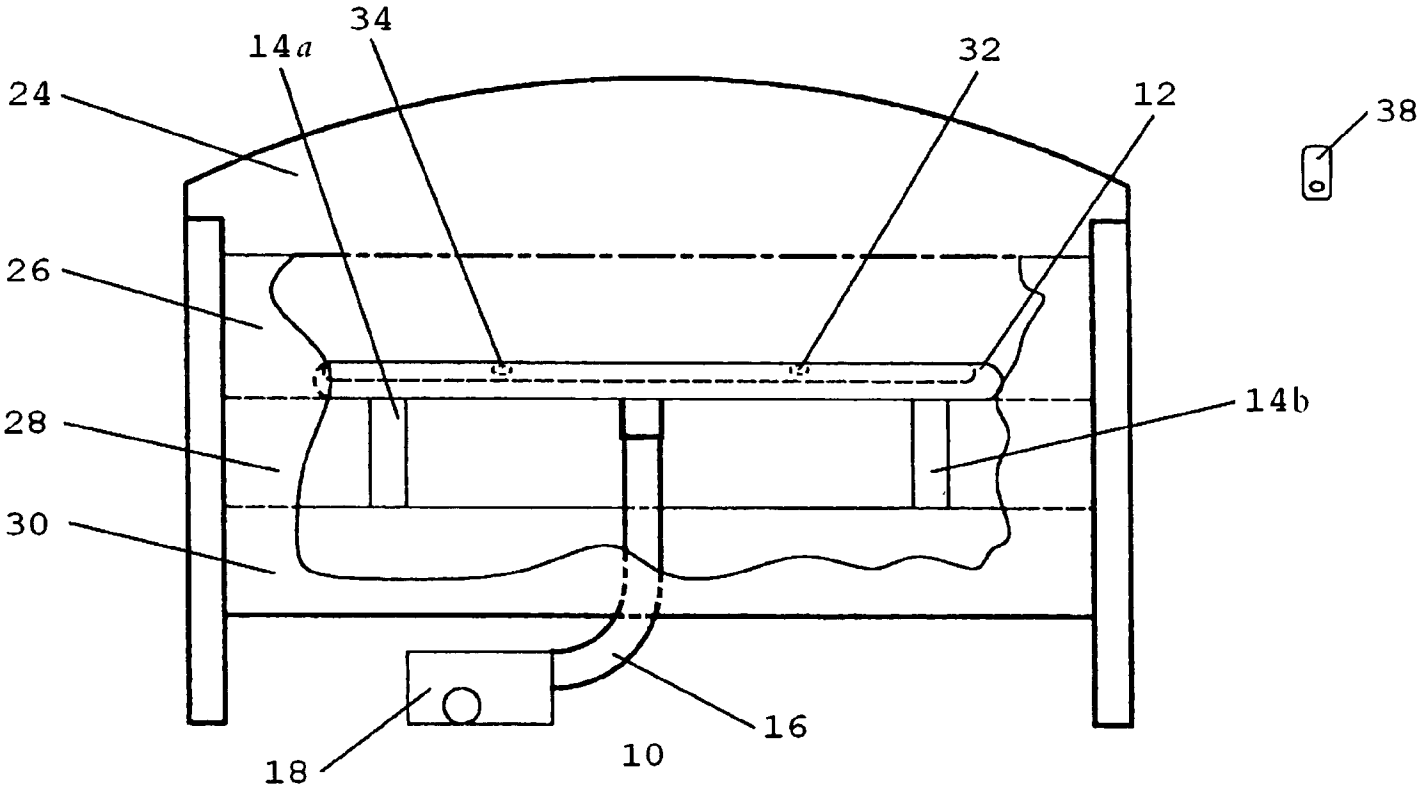
FIG. 2 is a front elevational view of a bed ventilator system shown in an installed end position on a bed with bed footboard cut away in part for direct viewing of bed ventilation system components.

A preferred embodiment of the bed ventilator of the present invention is illustrated in FIGS. 1 and 2. The drawn air bed ventilator system 10 includes a hollow body air extraction device 12 that fits horizontally across the foot of a single bed between the bottom sheet and the bed covers. A side of the extraction device 12 positioned toward the bed occupant 40 is apertured for the withdrawal of air. Support for the extraction device 12 is positioned tangent to a mattress such as twin supports 14*a* and 14*b* having thin flat feet designed to be slid between a mattress and a supporting bed structure to attach to and to hold in place the extraction device 12 at the mattress top surface. Conduit 16 directs withdrawn air from the extraction device 12 to a vacuum generating system 18 that provides negative air pressure as a motive force to withdraw air. The vacuum generating system 18 is preferably located underneath the bed or at the foot of a non-raised bed support structure. Bed top sheet 20 is tucked under the mattress on three sides in a traditional manner and is snugly tucked around conduit 16 as seen in FIG. 1.

Figure 4:
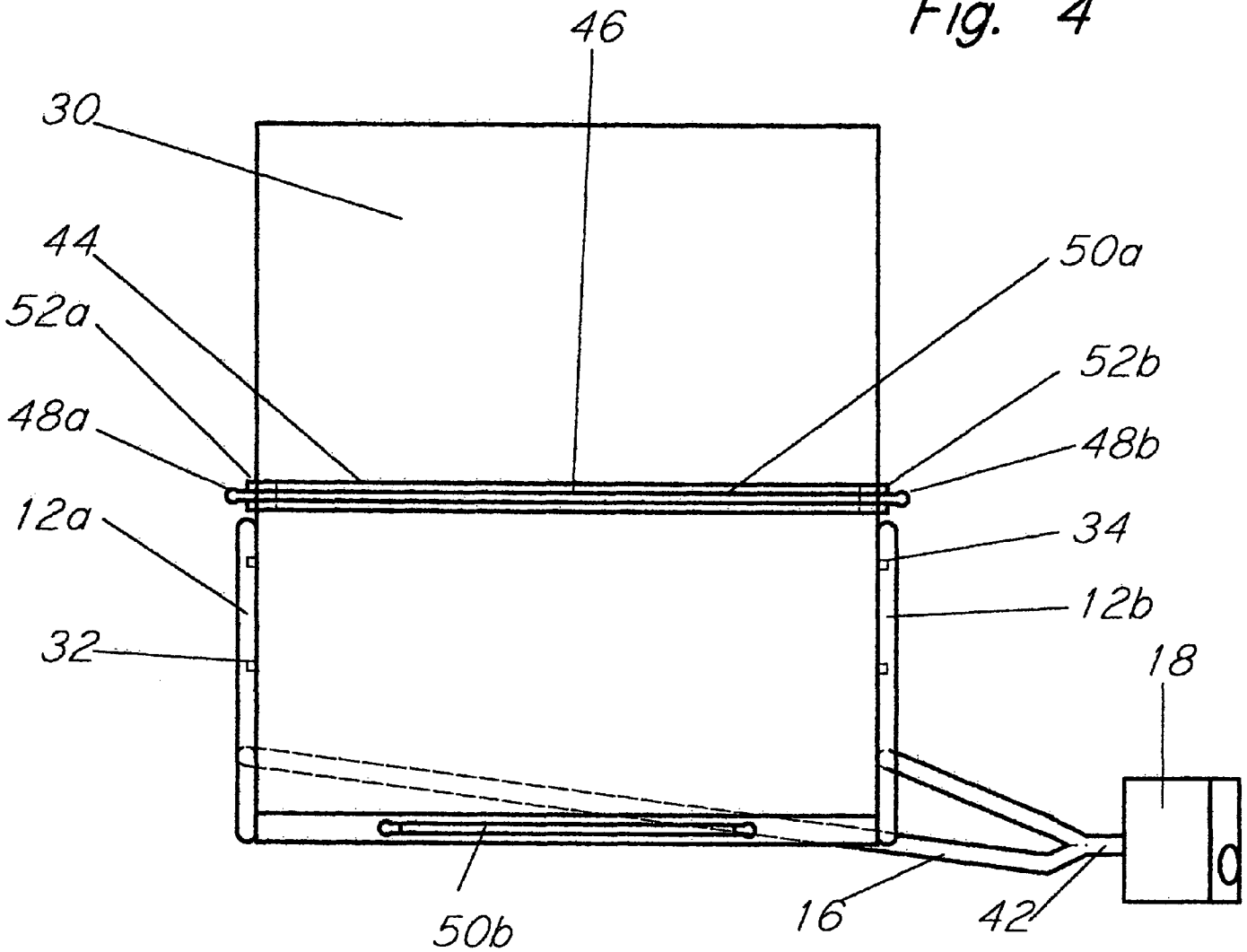
FIG. 4 is a cross-sectional top view taken substantially along lines 2-2 of FIG. 3 with mattress, bed covering, head board, and foot board removed for direct viewing of bed sheet tensioning elements.

A bed sheet tensioning device as depicted in FIG. 4 biases the top sheet bed covering 20 toward a tucked position between mattress 28 and mattress support 30. Applying slight tension ensures that top sheet bed covering 20 retains a tented channel through which air is withdrawn about the bed occupant's body while simultaneously ensuring that loose bed covering does not block air flow to extraction device 12. Anchor strap 44 spans the mattress support 30 top surface upon which mattress 28 lies and is held firmly in place by anchor brackets 52*a* and 52*b* that secure to the underside of mattress support 30. Tensile band 50 is affixed to anchor strap 44 at anchor point 46. Attached to either end of tensile band 50 are sheet clips 48*a* and 48*b*, which are removably clipped to their respective edge of top sheet 20 during sheet tucking when "making the bed."

Tensile band 50 is depicted in an extended position for clipping to an untucked bed sheet, while tensile band 50*a* is depicted in a retracted position representative of the bed sheet placement once tucked. The elasticity of anchor strap 44 is negligible relative to that of tensile band 50. Either end of tensile band 50 can extend and retract while being biased back toward relatively stationary anchor point 46.

The extraction device 12 is preferably made of suitable low thermal conductivity material such as durable plastic. Low thermal conductivity assures that inadvertent bodily contact by a bed occupant with the extraction device 12 will not result in a startling cold shock. While the conduit 16 may be fabricated of any material capable of directing negative pressure, a flexible tubing configuration may enhance sleeper comfort by attenuating rather than transmitting to the mattress any vibration generated by the vacuum generating system.

Operation

To refresh the air under the bedding covers along the body of a bed occupant, the vacuum generating system 18 draws negative pressure in conduit 16. Negative pressure is in turn directed to extraction device 12 via conduit 16. The negative pressure in extraction device 12 provides motive force to extract malodorous warm air from about the body and feet of a bed occupant as depicted in FIG. 1. By well-known physical action, ambient air flows from areas of higher pressure to areas of relatively lower pressure. Because the bed occupant is tucked under bed covering, the only inlet to replenish air extracted from the foot of the bed is at the occupant's neck and shoulders. Cooler ambient fresh air flows in about the occupant's neck and continues due to negative pressure along the confined channel formed along the occupant's body under the bed covering down to the extraction device 12. The moving air draws away odors that otherwise would exit from under bed covering at the head end of the bed near an occupant's face. The moving air also effectively cools the occupant's body through evaporative action as heat and moisture from perspiration are withdrawn. Because air flow under bedding covers is confined to the low volume channels defined by the mattress on the bottom, the top bed sheet on the top, and by either side of the bed occupant's body on the sides, as depicted in FIG. 1, the power required by vacuum generating system 18 and concomitant energy usage are lower than required for prior art inventions.

At least one bed sheet tensioning device is removably held onto mattress support 30 by anchor brackets 52*a* and 52*b*. FIG. 4 depicts two bed sheet tensioning devices, one above and one below extraction devices 12*a* and 12*b*. Mattress 28 is placed on top of the bed sheet tensioning devices for operation. When "making the bed" a bottom sheet is placed onto mattress 28 and the extraction device 12 is positioned with the apertured portion facing toward where a bed occupant will lay as seen in FIG. 1. A top sheet is placed over the mattress 28 and extraction device 12 and is clipped on each side with sheet clips 48*a* and 48*b* to tensile band 50 to assist with tucking top sheet edges between mattress 28 and mattress support 30. The bias toward the tucked position that the bed sheet tensioning device applies to top sheet 20 ensures that loose bedding cannot block airflow to extraction device 12.

In the most rudimentary configuration the vacuum generating system 18 is operated continuously to draw fresh air throughout the entire sleep cycle. By simply adding a temperature sensing device under bed covering adjacent the occupant's body a thermostatic control circuit is easily added to maintain a desired sleep temperature. Addition of a remote control for the vacuum generating system allows the bed occupant to control bed ventilation as desired for temperature and odor control. Incorporating a timer to control operation reduces energy usage.

Energy usage is also minimized by exhausting withdrawn air directly from vacuum generating system 18 without filtering when the bed ventilator is operated primarily to reduce under cover temperature via refreshing air flow. When the bed ventilator is operated to remove flatus or other bodily odor, however, it is desirable to treat withdrawn air in optional deodorizer 36 (shown in FIG. 3) prior to releasing exhaust. Deodorizer 36 may be a simple charcoal filter, an ionic air purifier, or dispenser of desirable fragrance, for example. Selection between direct exhaust or treated exhaust via deodorizer 36 can be accomplished manually or automatically.

Alternative Embodiment

Figure 3:
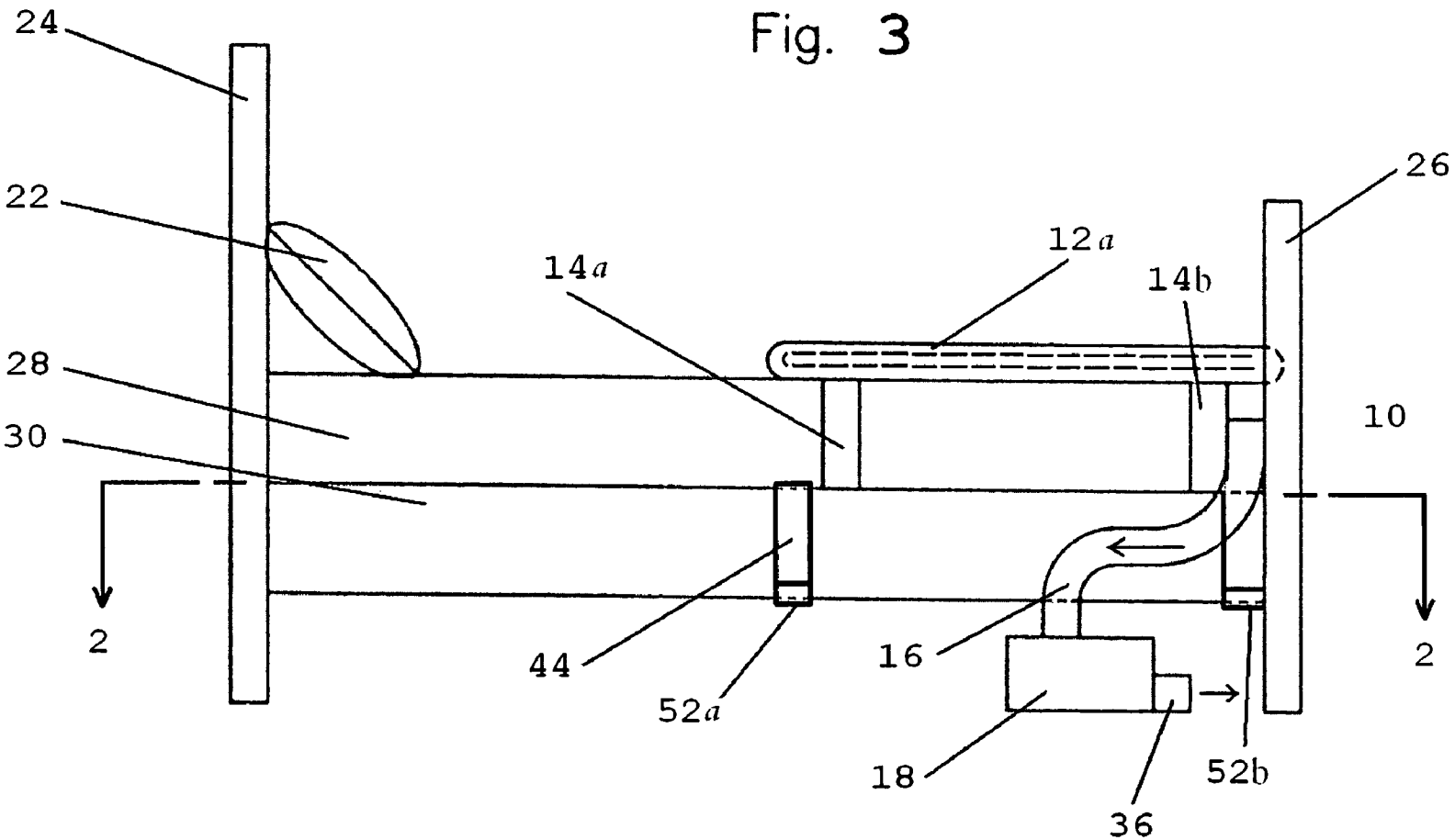
FIG. 3 is a side elevational view of a bed ventilator system in accordance with the present invention shown in an installed side position on a bed.

An alternative embodiment of the bed ventilator of the present invention is illustrated in FIGS. 3 and 4. The drawn air bed ventilator system 10 includes multiple hollow body air extraction devices 12*a* and 12*b* that fit horizontally along the foot-end sides of a shared bed between the bottom sheet and the bed covers. The side of each extraction device positioned toward the bed occupant 40 is apertured for the withdrawal of air therefrom. Support for the extraction devices 12*a* and 12*b* is in position tangent to a mattress such as the twin supports 14*a* and 14*b* having thin flat feet designed to be slid between a mattress and a supporting bed structure. Twin supports 14*a* and 14*b* attach to and hold in place the extraction device at the mattress top surface. Conduit 16 directs withdrawn air from the extraction devices 12*a* and 12*b* to a vacuum generating system 18 that provides negative air pressure as a motive force to withdraw air. The vacuum generating system is preferably located underneath the bed or at the foot of a non-raised bed support structure. Bed top sheet 20 is tucked under the mattress on three sides in a traditional manner and is snugly tucked around conduit 16.

In the alternative embodiment the multiple extraction devices 12*a* and 12*b* may be operated in tandem or independently according to bed occupant preference. Locating a simple diverter valve 42 at the conduit 16 junction to vacuum generating system 18 allows for extraction device flow selection while distancing any associated flow noise from bed occupants to better promote restful sleep. Of course, if so desired, an alternative embodiment could be deployed with a dedicated vacuum generating system 18 connected via an independent conduit 16 for each respective extraction device 12*a* or 12*b* to allow completely independent bed ventilator operation for each bed occupant.

As with the preferred embodiment the extraction devices 12*a* and 12*b* are preferably made of suitable low thermal conductivity material such as durable plastic. Low thermal conductivity assures that inadvertent bodily contact by a bed occupant with an extraction device 12*a* or 12*b* will not result in a startling cold shock. While the conduit 16 may be fabricated of any material capable of containing and directing negative pressure, a flexible tubing configuration may enhance sleeper comfort by attenuating rather than transmitting to the mattress any vibration generated by the vacuum generating system.

Alternative Embodiment of Operation

The alternative embodiment theory of operation to refresh the air under the bedding covers along the bodies of bed occupants is similar to that previously described in the preferred embodiment for use with a single extraction device 12. Vacuum generating system 18 draws negative pressure on conduit 16. The negative pressure in extraction devices 12*a* and 12*b* provides motive force to extract malodorous warm air from about the body and feet of the respective side bed occupant. By well-known physical action, ambient air flows from areas of higher pressure to areas of relatively lower pressure. Because the bed occupants are tucked under bed covering the unencumbered inlet to replenish air extracted from the foot end of the bed is at the occupants' necks and shoulders where the top sheet bed covering 20 rests upon the occupants' bodies. Cooler ambient fresh air flows in about the occupants' necks and continues due to negative pressure along the confined channel formed along the occupant's body under the bed covering down to the respective extraction devices 12*a* or 12*b*. The moving air whisks away odors that otherwise would remain trapped until exiting from under bed covering at the head end of the bed near an occupant's face. The moving drawn air also effectively cools the occupant's body through evaporative action as heat and moisture from perspiration are withdrawn via the respective extraction devices 12*a* or 12*b*.

Multiple extraction devices may be operated in tandem or independently according to bed occupant preference. A simple diverter valve 42 at the conduit 16 junction to vacuum generating system 18 allows for extraction flow selection while distancing any associated flow noise from bed occupants to better promote restful sleep. Of course, an alternative embodiment could be deployed with a dedicated vacuum generating system 18 connected via an independent conduit 16 from each respective extraction device 12*a* or 12*b* to allow independent bed ventilator operation for each bed occupant.

CONCLUSION

The reader will see that, according to the invention, the preferred bed ventilation system draws soothing air from head to toe under bedding cover directionally along the body of a bed occupant at rest. The instance bed ventilation system uses drawn air under negative pressure to provide temperature control and to remove malodorous air and flatus from under bedding covers. Electric power is conserved relative to existing bed ventilator solutions by using drawn air negative pressure to ventilate the low volume space formed along a bed occupant's body underneath a top sheet. Use of a standard mattress and standard sheet and bedding cover sets saves cost, adds convenience and improves user comfort relative to specialized ventilation mattress and bed covering systems. Simple integration with a standard bed mattress configuration obviates the unsightly and expensive frame rails infrastructure of existing tent ventilation systems. Addition of an optional remote control capability allows a bed occupant to draw comforting air or to discreetly remove flatus or bodily odors as desired. Positioning the extraction device under bed covering tangent to the plane of a mattress foot or bed side and level with the mattress top surface allows the bed occupant to slumber with no need to make bodily contact with bed ventilation system components.

In an automated configuration the drawn air bed ventilator senses the presence of hydrogen sulfide, mercaptan, or methane malodorous flatus content and automatically draws air to remove flatus from under bedding covers without disturbing the bed's occupants. Simple addition of a filter to remove malodorous content existent in extracted bed air prior to discharge into the bedroom further enhances user comfort. Addition of a temperature sensing device to the extraction device enables the bed ventilation system to sense temperature under bed covers and automatically withdraw air to cool bed occupants when warmer than optimal and cease air withdrawal to allow bed occupants to warm when cooler than optimal. Use of flexible conduit reduces vibration and noise relative to existing ventilation systems to better promote restful sleep. In an advance to the art, the present bed ventilation system draws soothing air from head to toe along a body at rest and removes malodorous air and flatus from under bedding covers for single or double bed occupant sleeping arrangements, wherein each bed occupant has independent air flow control for the respective side of the bed.

Also according to the invention, a convenient bed sheet tensioning apparatus is provided that is suitable for use both with the present bed ventilation system and absent the bed ventilation system to present a comfortable, wrinkle-free, aesthetically pleasing made bed.

While the above description contains many specificities, these should not be construed as limitations on the scope of the invention, but as exemplifications of the presently preferred embodiments thereof. Many other ramifications and variations are possible within the teachings of the invention. For example, if more direct airflow is desired from a particular body part, the extraction device may be juxtaposed the body part on the bed between the bottom sheet and the bed covers. A single extraction device can be used at the foot of a shared bed arrangement when bed occupants share similar refreshing airflow requirements. The single extraction device at the foot of a bed may be made longer or shorter to span more or less of the bed's width to accommodate differing user's preferences. In a shared bed arrangement wherein only one of the bed occupants desires refreshing air flow, only a single extraction device positioned on the bed side of the occupant desiring the refreshing effect need be deployed.

Thus the scope of the invention should be determined by the appended claims and their legal equivalents, and not by the examples given.

I claim:

1. An apparatus to be disposed about a bed for regulating air freshness and temperature about at least one bed occupant disposed under at least one bed covering by drawing air in a directional flow about a body of the at least one occupant, said apparatus comprising:

a. at least one extraction device means located under the at least one bed covering and proximate to the at least one bed occupant comprising flatus sensing means to automatically increase airflow in the presence of flatus;

b. a vacuum means to provide air pressure negative to ambient about the bed for drawing air;

c. a conduit in communication between the at least one extraction device means and the vacuum means to direct negative pressure from the vacuum means to the at least one extraction device means;

d. a remote control means for regulation of airflow;

e. a temperature sensing and control means to automatically increase or decrease airflow to maintain a temperature setpoint about the occupant's body under the bed covering;

f. twin supports that attach to the each extraction device means;

g. a bed sheet tensioning device to apply tension to at least one bed covering to ensure retention of a tented channel through which air is withdrawn about each bed occupant, said bed sheet tensioning device further comprising:

h. an anchor strap that spans atop surface of the mattress support, upon the anchor strap the mattress lies;

i. one or more anchor brackets that secure the anchor strap to the mattress support;

j. a tensile band having two ends;

k. two or more clips;

l. at least one clip attached to a first end of the tensile band;

m. at least one clip attached to a second end of the tensile band; and n. the tensile band being affixed to the anchor strap at an anchor point between each clip location wherein elasticity of the anchor strap is negligible relative to elasticity of the tensile band and wherein either end of the tensile band retracts toward the anchor point and the retracted length of the tensile band is less than a width of the mattress, and wherein the twin supports that attach to the each extraction device means are held proximate to a top surface of a mattress, the twin supports having thin flat feet that slide between the mattress and a supporting bed structure to hold in position the each extraction device means without contact with each occupant body by the each extraction device means.

2. An apparatus disposed about a bed for regulating air freshness and temperature about at least one occupant sharing one bed disposed under at least one bed covering by drawing air in a directional flow about the body of at least one occupant from head to toe, said apparatus comprising the mattress and the mattress support of the bed and a bed sheet tensioning device to apply tension to the bed covering to ensure retention of a tented channel through which air is withdrawn about each bed occupant, said apparatus further comprising:

a. at least one extraction device means disposed at each respective foot of the least one occupant, located along a lower half of the bed;

b. at least one vacuum means to provide negative air pressure for drawing air; and c. at least one conduit, in communication with the at least one extraction device means and the at least one vacuum means, to direct negative pressure from each vacuum means to each extraction device means d. an anchor strap that spans a top surface of the mattress support, upon the anchor strap the mattress lies;

e. one or more anchor brackets that secure the anchor strap to the mattress support;

f. a tensile band having two ends;

g. two or more clips;

h. at least one clip attached to a first end of the tensile band;

i. at least one clip attached to a second end of the tensile band; and j. the tensile band being affixed to the anchor strap at an anchor point between each clip location wherein elasticity of the anchor strap is negligible relative to elasticity of the tensile band and wherein either end of the tensile band retracts toward the anchor point and the retracted length of the tensile band is less than a width of the mattress, and wherein negative pressure inside the extraction device means causes air to be drawn under the bed covering along the occupant's body from head to toe.

3. The apparatus of claim 1 wherein the conduit is flexible and sufficiently long to allow the placement of the each extraction device means proximate to a part of the at least one bed occupant.

* * * * *